US006888107B2

(12) United States Patent
McFarland

(10) Patent No.: US 6,888,107 B2
(45) Date of Patent: May 3, 2005

(54) ONE-PIECE BURNER ELEMENT/SWITCH SUPPORT FOR A COOKTOP

(75) Inventor: James Coty McFarland, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/367,760

(22) Filed: Feb. 19, 2003

(65) Prior Publication Data

US 2004/0159651 A1 Aug. 19, 2004

(51) Int. Cl.[7] ..... H05B 3/68
(52) U.S. Cl. ..... 219/452.12; 219/460.1
(58) Field of Search ..... 219/443.1, 450.1, 219/452.11, 452.12, 460.1, 461.1, 462.1, 465.1, 467.1, 454.11, 454.12; 126/211, 217, 39 H, 39 J, 90 A, 92 AC, 92 A

(56) References Cited

U.S. PATENT DOCUMENTS 2,091,951 A * 9/1937 Anthony ..... 248/174
2,238,402 A * 4/1941 Smith ..... 219/452.11
3,567,906 A 3/1971 Hurko
3,632,983 A * 1/1972 Dills ..... 219/452.12
4,363,956 A 12/1982 Scheidler et al.
4,453,533 A 6/1984 Scheidler et al.
4,580,550 A 4/1986 Kristen et al.
4,608,962 A * 9/1986 Ng ..... 126/211
5,185,047 A 2/1993 Ray
5,571,434 A 11/1996 Cavener et al.
5,791,336 A 8/1998 Helm
5,841,109 A 11/1998 White et al.
5,847,364 A 12/1998 White et al.
6,122,165 A * 9/2000 Schmitt et al. ..... 361/685
6,236,024 B1 5/2001 Gotz et al.
6,300,602 B1 * 10/2001 Platt et al. ..... 219/445.1
6,313,447 B1 11/2001 Steiner et al.
6,343,009 B1 * 1/2002 Liu et al. ..... 361/684
6,410,892 B1 * 6/2002 Peschl et al. ..... 219/461.1

FOREIGN PATENT DOCUMENTS

GB 2143030 1/1985

* cited by examiner

*Primary Examiner*—Sang Y. Paik
(74) *Attorney, Agent, or Firm*—Diederiks & Whitelaw, PLC

(57) ABSTRACT

A cooktop includes a frame including a central web portion having a plurality of burner openings adapted to receive a plurality of burner elements, a control opening adapted to receive a control element assembly, and a cooking panel. More specifically, each of the plurality of burner openings and the control element opening has associated therewith a plurality of integrally formed tab elements. The cooking panel includes a plurality of cooking zones corresponding to the plurality of burner elements and is supported by the central web portion. Preferably, the cooking panel includes a peripheral rim portion that overhangs the central web, thereby eliminating any seams between the cooking panel and the frame.

17 Claims, 3 Drawing Sheets

ONE-PIECE BURNER ELEMENT/SWITCH SUPPORT FOR A COOKTOP

BACKGROUND OF THE INVENTION

1. Field of the Invention

The present invention pertains to the art of cooking appliances and, more particularly, to a cooktop having a one-piece frame adapted to support both a plurality of burner and control elements.

2. Discussion of the Prior Art

In general, cooking appliances in the form of cooktops are well known in the prior art. Typically, cooktops are associated with oven ranges or are mounted in kitchen islands. Conventionally, a cooktop includes a frame section having secured thereto a plurality of burner elements covered by a glass panel or cooking surface. In addition, a plurality of control elements, each of which is associated with a respective burner element, are also mounted to the cooktop. The burner elements are secured to the frame section using a variety of established methods including brackets which extend across openings in the frame, clamps, springs and the like. Each of the above methods requires a number of component parts which not only add to the overall complexity of the appliance, but likewise increase manufacturing and inventory costs. In the highly competitive field of kitchen appliances, reducing the number of component parts, in addition to lowering manufacturing costs, provides a substantial benefit to the manufacturer.

Typically, manufactures mount the control elements in a separate area of the frame section. This arrangement eliminates the need for complicated mounting brackets typically associated with the mounting of the controls or switches alongside the burner elements. However, the use of a separate section, dedicated solely to the controls, limits potential design configurations for the cooktop.

In addition to providing a separate portion of the frame to mount the controls, frame sections of the prior art include an internal ledge or support surface stamped or formed into a peripheral edge portion for supporting the cooking surface. With this arrangement, the cooking surface is located within the frame and able to support cookware. While the ledge portion does provide a somewhat stable supporting surface, the panel is only supported through an outer edge portion. As such, without additional structural considerations, the total weight able to be placed on the cooktop is limited. Also, inherent to this arrangement, a seam or crevice extends about a perimeter of the cooking surface. During normal cooking, food and other by-products such as grease and the like can become trapped in the crevice. Accordingly, constant cleaning is required to keep the cooktop sanitary.

Therefore, despite the existence of various cooktop constructions present in the prior art, there still exists a need for a cooktop that simplifies the manner in which burner elements are mounted to a frame, as well as providing a frame having an increased structural stability which allows for greater weight to be supported by the cooking surface.

SUMMARY OF THE INVENTION

The present invention is directed to a cooking appliance in the form of a cooktop including a frame element, a plurality of burner elements, a plurality of associated control members mounted to the frame element, and a cooktop panel defining a smooth-top cooking surface. Specifically, the frame element includes a central web defining a substantially horizontal planar portion, a plurality of openings arranged about the planar portion, and a peripheral rim portion extending perpendicularly from and extending about an outer edge of the central web.

In accordance a preferred embodiment of the present invention, each of the plurality of openings includes a pair of oppositely arranged tab elements. More specifically, each of the plurality of tab elements is integrally formed with the central web and includes a mounting aperture adapted to receive a mechanical fastener for removably supporting at least a portion of one of the plurality of burner elements within one of the plurality of openings. In accordance with the most preferred form of the invention, the plurality of openings include both burner element openings and a control member opening. In a manner similar to that described above, the control member opening includes associated tab elements for supporting the plurality of control members within the central web.

In further accordance with the invention, the cooktop panel is secured to the central web. More specifically, the cooktop panel is secured in a manner such that a peripheral edge portion of the cooktop panel overhangs the peripheral rim. In this manner, a larger surface area of the cooking surface is supported through the central web and, moreover, crevices or seams which are normally formed about the edges of the cooking surface are substantially eliminated.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
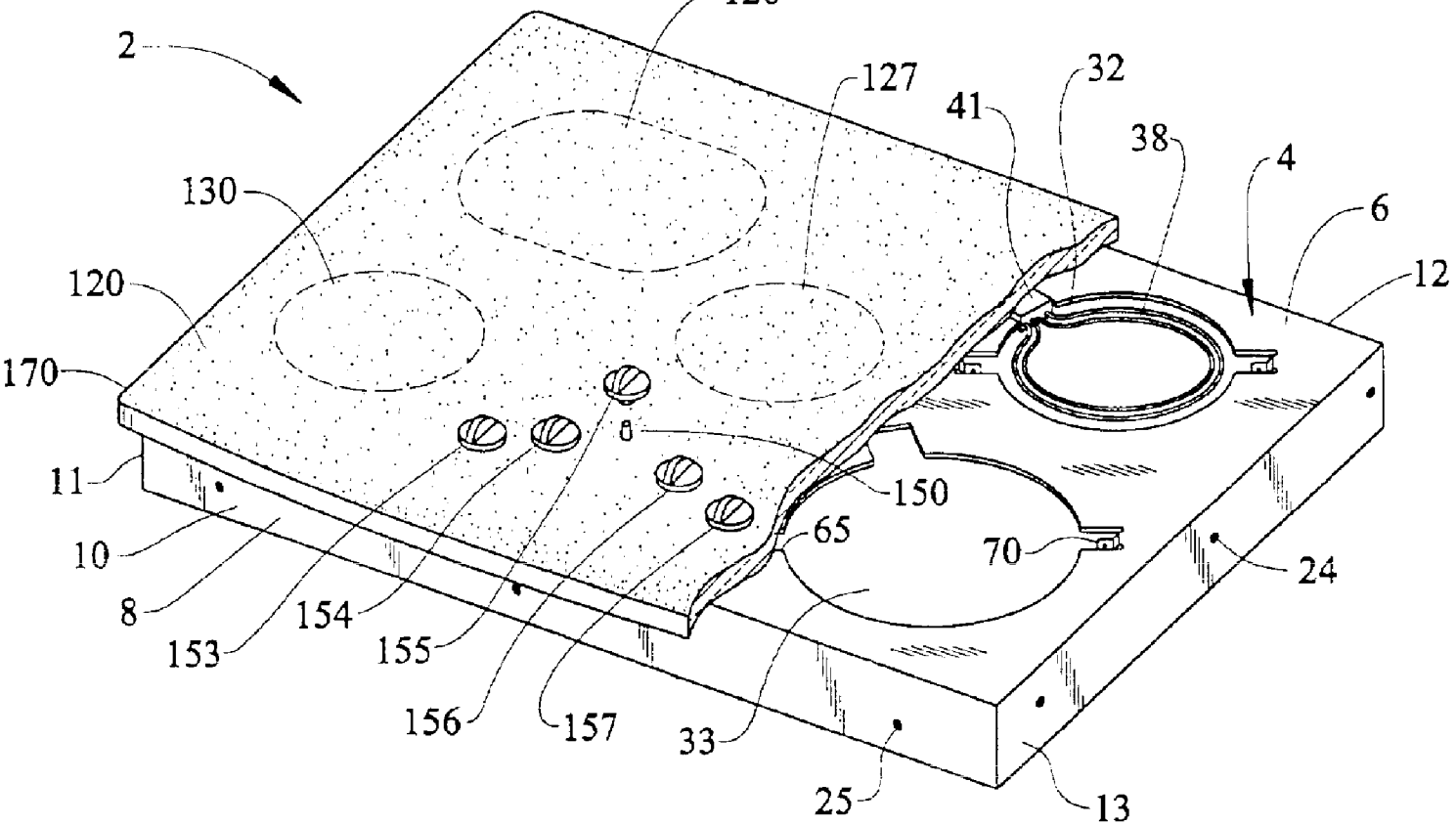
FIG. 1 is a partial, perspective cut-away view of a cooktop cooking appliance illustrating a portion of a frame section and burner mounting structure constructed in accordance with the present invention.

With initial reference to FIG. 1, a cooking appliance constructed in accordance with the present invention is generally shown at 2. Although the actual cooking appliance into which the present invention may be incorporated can vary, cooking appliance 2 preferably constitutes a cooktop which can be incorporated into a kitchen countertop assembly. However, it should be understood that the present invention is not limited to this model type and can be incorporated into various types of oven range configurations, e.g., both free-standing and slide-in ranges. In the embodiment shown, cooking appliance 2 includes a frame section 4 having a central web 6 and a peripheral side portion 8. As will be discussed more fully below, frame section 4 is formed from a single stamped piece of material, preferably metal. As illustrated, peripheral side portion 8 extends substantially perpendicularly from an outer perimeter portion (not separately labeled) of central web 6. More specifically, peripheral side portion 8 is constituted by a plurality of interconnected side walls 10–13. Although not shown, frame section 4 can also be provided with a bottom panel arranged spaced from and substantially parallel to central web 6.

Figure 3:
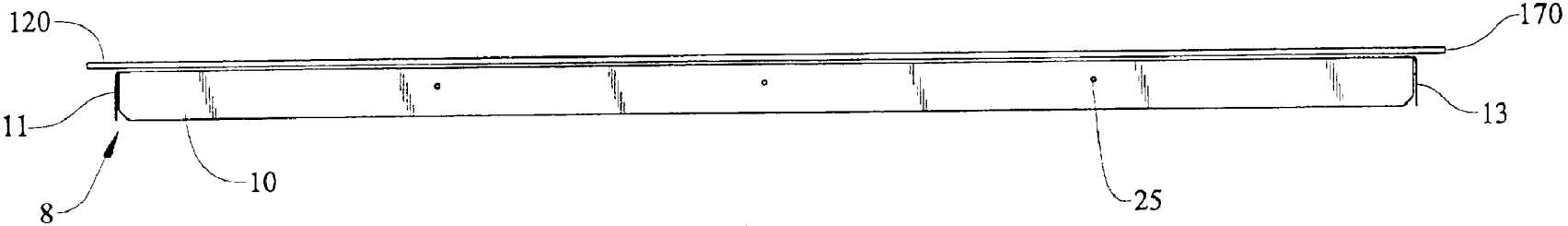
FIG. 3 is a front elevational view of the cooktop of FIG. 2 illustrating a portion of a peripheral rim portion of the frame section.
Figure 5:
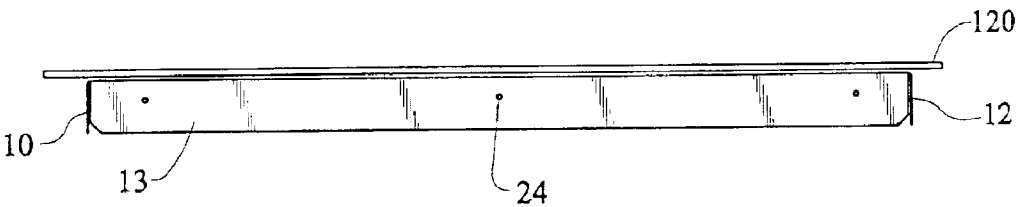
FIG. 5 is an elevational side view of the cooktop and frame section of FIG. 2.

In accordance with a preferred form of the invention, frame section 4 rests upon a burner box (not shown). More specifically, front and rear sidewalls 10 and 13 of peripheral side portion 8 are supported by associated front and rear burner box flanges (also not shown) during an installation process. In any case, as best seen in FIGS. 1, 3 and 5, located along side walls 10–13 are a plurality of frame section mounting apertures, two of which are indicated at 24 and 25. Frame mounting apertures 24 and 25 are provided to secure frame section 4 within a corresponding support structure (not shown) which can be defined within an oven range, kitchen countertop, or the like depending upon the particular model or application of cooktop 2.

Arranged about central web 6 are a plurality of burner openings 30–34 (see FIGS. 1 and 2), each being adapted to receive a respective burner element, one of which is indicated at 38 in FIG. 1. In the embodiment shown, connector block 41 interconnects and supports end portions of burner element 38. In addition to burner openings 30–34, a control element opening 45 is interposed within the array of burner openings 30–34 for receiving a control element assembly not shown. While not shown, preferably associated with each burner element 38 is a corresponding temperature sensor which, in addition to a monitoring function, will provide an indication to a consumer that a particular burner element 38 is in operation or remains hot after being shut-off.

Figure 2:
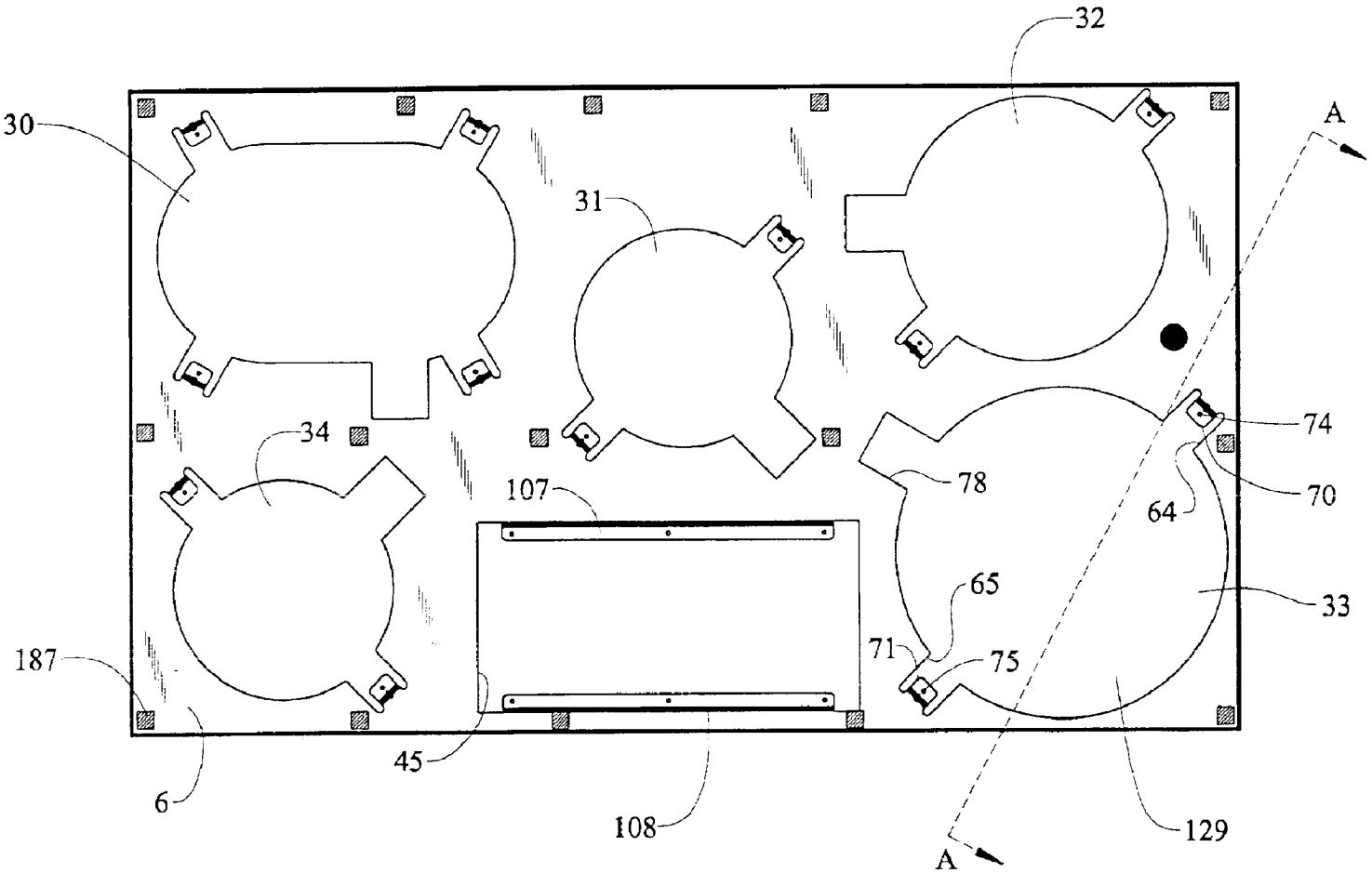
FIG. 2 is a top view of the cooktop illustrating a particular burner and control element opening arrangement of the present invention.
Figure 4:
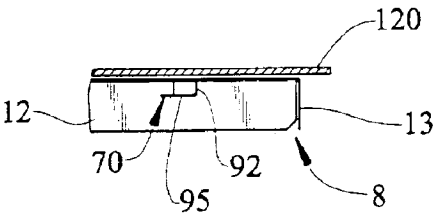
FIG. 4 is a partial side elevational view of the cooktop of FIG. 2 cut-away along reference line A—A to illustrate a tab element projecting adjacent one of the burner openings.

Reference will now be particularly made to FIGS. 2 and 4 in describing the preferred structure of burner openings 30–34. Actually, since the structure of each burner opening is essentially identical, a detailed description of burner opening 33 will be made and it is to be understood that openings 30–32 and 34, while being geometrically different, have commensurate structure. Formed within opening 33 are a pair of diametrically opposed notches 64 and 65 from which project respective burner support or tab elements 70 and 71. More specifically, each burner support or tab element 70, 71 is integrally formed from central web portion 6. As best seen in FIG. 2, each burner support element 70, 71 includes a respective mounting aperture 74 and 75 for attaching a respective burner element, such as that shown at 38 in FIG. 1. In addition to notches 64 and 65, a third notch 78 is formed within opening 33 for removably receiving connection block 41 as shown in FIG. 1. Notch 78 may also be used to support a separate temperature sensor (not shown) which, as discussed above, will monitor the temperature associated with a particular cooking zone.

Reference will now be made to FIG. 4 in describing the specific structure of burner support elements 70 and 71. Since the structure of each support element 70, 71 is identical, a detailed description of support element 70 will be made and it is to be understood that support element 71 has commensurate structure. As illustrated, support element 70 includes a first segment 92 projecting downward from a lower surface of central web 6. As further shown in FIG. 4, a second segment 95 projects substantially perpendicularly from first segment 92 and through which extends mounting aperture 74. With this arrangement, burner element 38 can be fastened to support elements 70 and 71 through a plurality of mechanical fasteners, clips or the like (not shown). In this manner, the overall manufacturing process is not only simplified, but the need for additional, complicated mounting hardware is eliminated.

Unlike openings 30–34, control opening 45 includes a pair of opposing control element mounting tabs 107 and 108. Although control element mounting tabs 107 and 108 are depicted as a pair of opposing rail sections formed from central web 6, it should be understood that this structure could be constituted by a plurality of shorter tab elements similar to burner support elements 70 and 71. In any event, control element mounting tabs 107 and 108 are integrally formed from central web 6 in a manner similar to that used to create burner mounting support elements or tabs 70 and 71.

In the most preferred form of the invention, a ceramic-based cooking panel 120 having a plurality of cooking zones, three of which are shown at 126, 127 and 130 in FIG. 1, is positioned upon frame section 4 over central web 6. In addition to cooking zones 126, 127 and 130, a plurality of control element shaft receiving openings (not shown) are located on cooking panel 120 above control element opening 45. Referring to FIGS. 1 and 2, the control element shaft openings are provided to receive a respective control element shaft, one of which is indicated at 150 in FIG. 1, for mounting a respective control knob 153–157. Each of control knobs 153–157 is used to selectively control, in combination with an associated control switch, the heat output of each respective burner element 38.

In accordance with the most preferred form of the invention, cooking panel 120 is positioned upon central web 6 so that an outer rim 170 of cooking panel 120 extends about and overhangs peripheral edge portion 8 in a cantilevered fashion. Cooking panel 120 is secured to central web 6 using an adhesive, such as RTV or the like. As shown in FIG. 2, a plurality of pads, one of which is indicated at 187, are arranged about central web 6 and are used to support cooking panel 120 above frame section 4. Preferably pads 187 maintain a partial gap of approximately 0.09" (2.3 mm) between cooking panel 120 and frame section 4. In any event, other methods of securing cooking panel 120 to central web 6 would be acceptable, while avoiding the need for seams between cooking panel 120 and frame section 4.

Although described with reference to preferred embodiments of the invention, is should be readily understood that various changes and/or modifications can be made to the invention without departing from the spirit thereof. For instance, the particular arrangement, shape, and number of burner openings can be varied without departing from the scope of the present invention. Additionally, while a control switch is shown associated with each burner element for use in controlling the heat output of the burner, it should be understood that placing the control switch adjacent to the control knob or providing an integrally formed knob and switch arrangement would be equally acceptable. Finally, while the cooktop has been described in connection with electric burner elements, gas burner assemblies could be employed. In general, the invention is only intended to be limited by the scope of the following claims.

I claim:

1. A cooktop comprising:

a frame including a central web defining a substantially horizontal planar portion, a plurality of openings arranged about and extending through the horizontal planar portion, and a peripheral rim portion extending downwardly from an outer periphery of the central web;

a plurality of tab elements integrally formed from the central web, each of said plurality of tab elements projecting about a respective one of the plurality of openings;

a plurality of burner elements, each of said plurality of burner elements being interconnected with a respective one of the plurality of tab elements to position each one of the plurality of burner elements in a respective one of the plurality of openings;

a plurality of control elements, each of said plurality of control elements being mounted at one of the plurality of openings through associated ones of the plurality of tab elements; and a cooktop panel extending over the central web and including a plurality of cooking zones, each of said cooking zones corresponding to a respective one of said plurality of burner elements, said cooktop panel being secured to the central web of the frame with an outer edge portion of the cooktop panel overhanging and being cantilevered from the frame.

2. A cooktop comprising:

a frame including a central web defining a substantially horizontal planar portion, a plurality of openings arranged about and extending through the horizontal planar portion, and a peripheral rim portion extending downwardly from an outer periphery of the central web;

a plurality of tab elements integrally formed from the central web, each of said plurality of tab elements projecting about a respective one of the plurality of openings;

a plurality of burner elements, each of said plurality of burner elements being interconnected with a respective one of the plurality of tab elements to position each one of the plurality of burner elements in a respective one of the plurality of openings;

a plurality of control elements, each of said plurality of control elements being mounted at one of the plurality of openings through associated ones of the plurality of tab elements; and a cooktop panel secured to and extending over the central web and including a plurality of cooking zones, each of said cooking zones corresponding to a respective one of said plurality of burner elements.

3. The cooktop according to claim 2, wherein the burner openings include at least two, peripherally spaced notch portions, each of said notch portions having extending therein a respective one of the plurality of tab elements.

4. The cooktop according to claim 3, wherein each one of the plurality of tab elements includes a mounting aperture for receiving a mechanical fastener used to secure a respective one of the burner elements.

5. The cooktop according to claim 2, further comprising: a plurality of mounting apertures arranged about the peripheral side portion, said mounting apertures being adapted to receive a mechanical fastener for mounting of the cooktop.

6. The cooktop according to claim 2, wherein the cooktop panel is secured to the frame with an outer edge portion of the panel overhanging the frame.

7. The cooktop according to claim 2, wherein the cooktop panel is formed from a ceramic-based material and adhesively secured to the frame.

8. The cooktop according to claim 7, wherein the cooktop panel is spaced above the central web by a plurality of pads.

9. The cooktop according to claim 2, wherein the plurality of control elements are mounted in the control element opening with a portion of each of the plurality of control elements extending through the cooktop panel.

10. A cooktop comprising:

a frame including a central web defining a substantially horizontal planar portion, a plurality of openings arranged about and extending through the horizontal planar portion, and a peripheral rim portion extending downwardly from an outer periphery of the central web;

a plurality of burner elements, each of said plurality of burner elements being mounted in a respective one of the plurality of openings;

a plurality of control elements, each of said plurality of control elements being mounted at one of the plurality of openings; and a cooktop panel extending over the central web and including a plurality of cooking zones, with each of said cooking zones corresponding to a respective one of said plurality of burner elements, said cooktop panel being secured to the central web of the frame with an outer edge portion of the cooktop panel overhanging and being cantilevered from the frame.

11. The cooktop according to claim 10, wherein the cooktop panel is formed from a ceramic-based material and adhesively secured to the frame.

12. The cooktop according to claim 11, wherein the cooktop panel is spaced above the central web by a plurality of pads.

13. The cooktop according to claim 10, further comprising: a plurality of tab elements integrally formed from the central web, each of said plurality of tab elements projecting about a respective one of the plurality of openings, with each of said plurality of burner elements being attached to the frame through a respective one of the plurality of tab elements.

14. The cooktop according to claim 13, wherein the burner openings include at least two, peripherally spaced notch portions, each of said notch portions having extending therein a respective one of the plurality of tab elements.

15. The cooktop according to claim 14, wherein each one of the plurality of tab elements includes a mounting aperture for receiving a mechanical fastener used to secure a respective one of the burner elements.

16. The cooktop according to claim 10, further comprising: a plurality of mounting apertures arranged about the peripheral rim, said mounting apertures being adapted to receive a mechanical fastener for mounting of the cooktop.

17. The cooktop according to claim 10, wherein the plurality of control elements are mounted in the control element opening with a portion of each of the plurality of control elements extending through the cooktop panel.

* * * * *